US009219299B2

(12) United States Patent
Kondo et al.

(10) Patent No.: US 9,219,299 B2
(45) Date of Patent: Dec. 22, 2015

(54) RESONATOR, MULTILAYER BOARD AND ELECTRONIC DEVICE

(71) Applicants: NEC TOKIN CORPORATION, Sendai-shi, Miyagi (JP); NATIONAL UNIVERSITY CORPORATION OKAYAMA UNIVERSITY, Okayama-shi, Okayama (JP)

(72) Inventors: Koichi Kondo, Sendai (JP); Naoharu Yamamoto, Sendai (JP); Yoshitaka Toyota, Okayama (JP); Kengo Iokibe, Okayama (JP); Farhan Zaheed Mahmood, Okayama (JP)

(73) Assignees: NEC TOKIN CORPORATION, Sendai-Shi, Miyagi (JP); NATIONAL UNIVERSITY CORPORATION OKAYAMA UNIVERSITY, Okayama-Shi, Okayama (JP)

( * ) Notice: Subject to any disclaimer, the term of this patent is extended or adjusted under 35 U.S.C. 154(b) by 113 days.

(21) Appl. No.: 13/972,172

(22) Filed: Aug. 21, 2013

(65) Prior Publication Data

US 2014/0055208 A1 Feb. 27, 2014

(30) Foreign Application Priority Data

Aug. 27, 2012 (JP) ..... 2012-186548
Apr. 11, 2013 (JP) ..... 2013-082762

(51) Int. Cl.
*H01P 3/08* (2006.01)
*H01P 7/10* (2006.01)
(Continued)

(52) U.S. Cl.
CPC ..... *H01P 7/10* (2013.01); *H01P 1/2005* (2013.01); *H01P 1/20381* (2013.01); *H01P 7/082* (2013.01)

(58) Field of Classification Search
CPC ..... H01P 7/10
USPC ..... 33/134, 126, 103, 262; 333/134, 126, 333/103, 262, 219, 185, 197–198
See application file for complete search history.

(56) References Cited

U.S. PATENT DOCUMENTS 5,248,950 A 9/1993 Horisawa et al.
6,794,952 B2 9/2004 Killen et al.
(Continued)

FOREIGN PATENT DOCUMENTS

JP 04-323901 A 11/1992
JP 2003-179406 A 6/2003
(Continued)

OTHER PUBLICATIONS

Hiroyasu San et al., "A Study of the optimal selection of parts to reduce the power ground plane resonance," IEICE Technical Report, Jul. 2012, vol. 112, Issue 120, pp. 19-21.

*Primary Examiner* — Dinh Le
(74) *Attorney, Agent, or Firm* — Holtz, Holtz, Goodman & Chick PC

(57) ABSTRACT

A resonator is connected to a first plane which is one of a power plane and a ground plane, wherein the power plane and the ground plane are apart from each other in an up-down direction. The resonator comprises a connecting portion and a body portion. The connecting portion is connected to the first plane. The connecting portion extends in the up-down direction beyond a second plane, which is a remaining one of the power plane and the ground plane, while not being in electrical contact with the second plane. The body portion is connected to the connecting portion while not being in contact with the second plane. The body portion is arranged so that the second plane is located between the body portion and the first plane in the up-down direction.

11 Claims, 4 Drawing Sheets

(51) Int. Cl.

| | |
|---|---|
| ***H01P 1/20*** | (2006.01) |
| ***H01P 1/203*** | (2006.01) |
| ***H01P 7/08*** | (2006.01) |

(56) References Cited

U.S. PATENT DOCUMENTS

| | | | | |
|---|---|---|---|---|
| 6,825,734 | B2 * | 11/2004 | Clark | 331/96 |
| 7,446,880 | B2 * | 11/2008 | Vollmer et al. | 356/480 |
| 8,253,029 | B2 | 8/2012 | Nakano et al. | |
| 2009/0315648 | A1 | 12/2009 | Toyao | |
| 2013/0021739 | A1 * | 1/2013 | Kim et al. | 361/679.31 |
| 2013/0068515 | A1 * | 3/2013 | Toyao et al. | 174/260 |

FOREIGN PATENT DOCUMENTS

| | | | |
|---|---|---|---|
| JP | 2004-032768 | A | 1/2004 |
| JP | 2004-140210 | A | 5/2004 |
| JP | 2008-048445 | A | 2/2008 |
| JP | 2009-239559 | A | 10/2008 |
| JP | 2009-296306 | A | 12/2009 |
| JP | 2010/010183 | A | 1/2010 |
| JP | 4643845 | B2 | 3/2011 |
| JP | 2011-160428 | A | 8/2011 |
| JP | 2011-176653 | A | 9/2011 |
| WO | WO 2008/103010 | A1 | 11/2008 |

* cited by examiner

RESONATOR, MULTILAYER BOARD AND ELECTRONIC DEVICE

CROSS REFERENCE TO RELATED APPLICATIONS

Applicants claim priority under 35 U.S.C. §119 of Japanese Patent Applications No. JP2012-186548 filed Aug. 27, 2012 and No. JP2013-082762 filed Apr. 11, 2013.

BACKGROUND OF THE INVENTION

This invention relates to a resonator which is provided in a multilayer board including a power plane and a ground plane, and which is configured to reduce a noise, particularly a high frequency noise, generated between the power plane and the ground plane.

An electronic device such as a personal computer (PC) has a printed circuit board installed therewithin. In general, the installed printed circuit board is a multilayer board including a power plane, a ground plane and a signal plane. The thus-formed multilayer board generates various high frequency noises under some conditions.

Each of Patent Document 1 (JPA 2004-140210) and Nonpatent Document 1 (Hiroyasu Sano, Yoshiaki Maruyama and Akihiro Tokikawa, "A Study of the Optimal Selection of Parts to Reduce the Power Ground Plane Resonance", Shingaku Gihou, The Institute of Electronics, Information and Communication Engineers, July 2012, volume 112, issue 130, pages 19 to 21) discloses a structure of the multilayer board for reducing the aforementioned noises, contents of Patent Document 1 and Nonpatent Document 1 are incorporated herein by reference.

A substrate (multilayer board) of Patent Document 1 comprises a power-supply voltage plane (power plane), a base voltage plane (ground plane), a signal wiring plane (signal plane) and a stub plane. The power-supply voltage plane is configured to supply electric power from a main power source through a power supplying path. The signal wiring plane has large scale integration (LSI) packages (electronic components) mounted thereon. The stub plane is provided with a stub. The power-supply voltage plane and the base voltage plane are connected with each other via a capacitor. The capacitor is provided between the power-supply voltage plane and the LSI packages in the power supplying path. The stub is provided between the main power source and the capacitor in the power supplying path. The stub has a connected end and an open end. The connected end extends through a dielectric layer to be connected to the base voltage plane or the power-supply voltage plane. According to the Patent Document 1, since the stub has a length which is equal to a quarter of a wavelength of a synchronous switching noise caused by the LSI packages, the synchronous switching noise (i.e. the noise due to the clock synchronization of the LSI packages) can be reduced.

Nonpatent Document 1 discloses a power plane and a ground plane connected with each other via one or more snubber circuits. Each of the snubber circuits consists of a capacitor and a resistor connected in series. According to Nonpatent Document 1, if the snubber circuit is adjusted to have proper characteristics such as a proper resistance, it is possible to reduce an undesirable radiation noise and to prevent a malfunction of an electric device which might be caused by resonance between the power plane and the ground plane.

In general, a power plane and a ground plane of a multilayer board are required to be provided with an insulator layer (i.e. a dielectric layer) therebetween. As disclosed in Nonpatent Document 1, a parallel plate resonance may be generated between the thus-arranged power plane and ground plane so that the electric device does not behave properly and the undesirable noise is radiated. Such noise that is caused from the multilayer board itself cannot be reduced by using the technology disclosed in Patent Document 1. Moreover, according to the technology disclosed in Nonpatent Document 1, the characteristics (for example, the resistance), of the snubber circuit cannot be properly designed until an arrangement of electric components on a signal plane is determined. In addition, a plurality of the snubber circuits is necessary to reduce the respective noises having various frequencies. However, it is difficult to properly adjust the resistance of each of the snubber circuits. Thus, the technology disclosed in Nonpatent Document 1 is not effective to reduce the parallel plate resonance generated between the power plane and the ground plane and, therefore, is not effective to prevent the malfunction of the electric device or to reduce the undesirable radiation noise caused by the parallel plate resonance.

SUMMARY OF THE INVENTION

It is therefore an object of the present invention to provide a resonator which is able to more effectively and more easily reduce a parallel plate resonance generated between a power plane and a ground plane.

A first aspect of the present invention provides a resonator connected to a first plane which is one of a power plane and a ground plane, wherein the power plane and the ground plane are apart from each other in an up-down direction. The resonator comprises a connecting portion and a body portion. The connecting portion is connected to the first plane. The connecting portion extends in the up-down direction beyond a second plane, which is a remaining one of the power plane and the ground plane, while not being in electrical contact with the second plane. The body portion is connected to the connecting portion while not being in contact with the second plane. The body portion is arranged so that the second plane is located between the body portion and the first plane in the up-down direction.

A second aspect of the present invention provides a multilayer board comprises one or more power planes, one or more ground planes and a resonator. The power planes include a predetermined power plane. The ground planes include a predetermined ground plane which is apart from the predetermined power plane in an up-down direction. The resonator is connected to a first plane which is one of the predetermined power plane and the predetermined ground plane. The resonator has a connecting portion and a body portion. The connecting portion is connected to the first plane. The connecting portion extends in the up-down direction beyond a second plane, which is a remaining one of the predetermined power plane and the predetermined ground plane, while not being in electrical contact with the second plane. The body portion is connected to the connecting portion while not being in contact with the second plane. The second plane is located between the body portion and the first plane in the up-down direction.

A third aspect of the present invention provides an electronic device comprising the multilayer board according to the second aspect of the present invention.

The resonator according to the present invention comprises the connecting portion and the body portion, wherein the connecting portion is connected to the first plane which is one of the power plane and the ground plane, the connecting portion extends beyond the second plane, which is a remaining one of the power plane and the ground plane, while not being in electrical contact with the second plane, and the body portion is connected to the connecting portion while not being in contact with the second plane. In other words, the resonator according to the present invention is configured to relate to both the power plane and the ground plane. Moreover, the resonator is configured to have an open end. Accordingly, the resonator is able to more effectively and more easily reduce the parallel plate resonance generated between the power plane and the ground plane.

An appreciation of the objectives of the present invention and a more complete understanding of its structure may be had by studying the following description of the preferred embodiment and by referring to the accompanying drawings.

Figure 1:
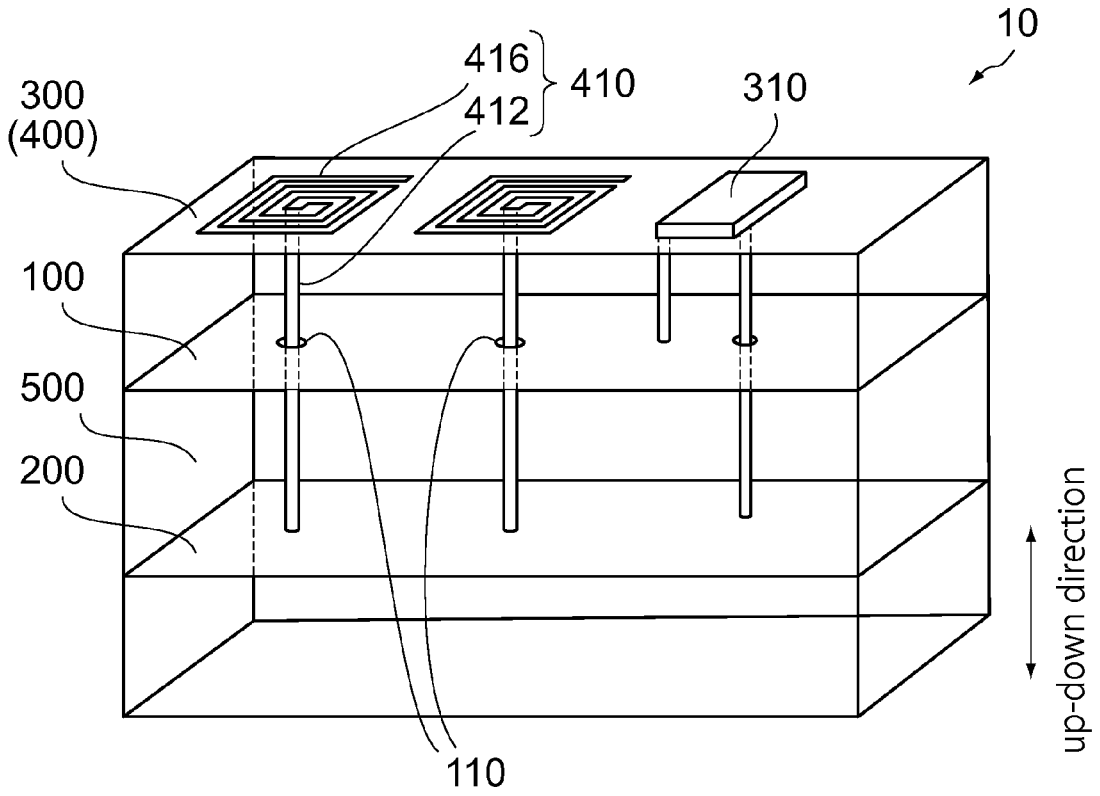
FIG. 1 is a perspective view schematically showing a multilayer board which is provided with a stub according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

As shown in FIG. 1, a multilayer board 10 according to a first embodiment of the present invention is formed from insulating bodies (i.e. dielectric bodies) and planes each having a conductive pattern. The insulating bodies and the planes are stacked alternately. The planes are electrically connected with one another, for example, by via holes. The multilayer board 10 is installed and used in an electric device (not shown) such as a personal computer (PC).

The multilayer board 10 according to the present embodiment comprises one power plane 100, one ground plane 200 and one signal plane 300 as the aforementioned planes. However, the multilayer board 10 may comprise, for example, a plurality of the power planes 100 and/or a plurality of the ground planes 200. When the multilayer board 10 comprises a plurality of the power planes 100, the power planes 100 may be connected with one another. Thus, the multilayer board 10 may comprise at least one power plane 100 (predetermined power plane 100) and at least one ground plane 200 (predetermined ground plane 200) which are apart from each other in an up-down direction.

According to the present embodiment, each of the power plane 100 and the ground plane 200 is an inner plane of the multilayer board 10 while the signal plane 300 is an outer plane of the multilayer board 10. The power plane 100 receives electric power supplied from a main power source (not shown). The signal plane 300 is provided with various electronic components 310 such as an integrated circuit (IC) chip 310 mounted thereon. Each of the electronic components 310 is connected with the power plane 100 and the ground plane 200 through via holes so that the electronic components 310 receive the electric power which is supplied to the power plane 100.

According to the present embodiment, the power plane 100 and the ground plane 200 are apart from each other in the up-down direction. In detail, the power plane 100 and the ground plane 200 extend in respective horizontal planes so as to sandwich a dielectric layer 500 made of an insulating material in the up-down direction.

The multilayer board 10 according to the present embodiment further comprises two (i.e. a plurality of stubs (resonators) 410. If the multilayer board 10 comprises no stub 410, some problems might be caused as described below.

When the electric power is supplied to the power plane 100 configured as described above, the electronic component 310 may generate a noise, for example, a simultaneous switching noise. The thus-generated noise is transferred to the dielectric layer 500. The noise transferred to the dielectric layer 500 might affect the other electronic components. For example, if another electronic component which processes a weak high-frequency signal (for example, a low noise amplifier for amplifying an antenna signal) is mounted on the signal plane 300 where the electronic component 310, or the noise source, is mounted, this another electronic component might work improperly.

Moreover, a parallel plate resonance is generated between the power plane 100 and the ground plane 200. In detail, an electromagnetic wave having a resonant frequency (i.e. a standing wave) is generated in the dielectric layer 500 sandwiched between the power plane 100 and the ground plane 200. This standing wave behaves as a noise. The amplitude of this standing wave has a maximum value at an anti-node thereof. For example, if the low noise amplifier is arranged at the anti-node of this standing wave, the low noise amplifier is simultaneously affected. Moreover, the circumference of the multilayer board 10 in a horizontal plane is an open end which is necessarily located at the anti-node of this standing wave. Accordingly, an undesirable electromagnetic wave is radiated to the outside of the multilayer board 10.

However, the multilayer board 10 according to the present embodiment comprises the stub 410. Accordingly, as described below, it is possible to reduce the aforementioned noise generated between the power plane 100 and the ground plane 200. In other words, the high frequency noise generated from the multilayer board 10 itself can be reduced.

As shown in FIG. 1, each of the stubs 410 includes a connecting portion 412 and a body portion 416. The body portion 416 of the stub 410 according to the present embodiment is provided on the signal plane 300. In other words, according to the present embodiment, the signal plane 300 is a stub plane (resonator plane) 400 where the body portion 416 of the stub 410 is provided. However, the stub plane 400 may be a plane other than the signal plane 300.

According to the present embodiment, the power plane 100 is located between the ground plane 200 and the stub plane 400 in the up-down direction. The connecting portion 412 of the stub 410 is connected to the ground plane 200. The connecting portion 412 extends to the stub plane 400 beyond the power plane 100 in the up-down direction while not being in electrical contact with the power plane 100. In detail, the power plane 100 is formed with a through hole 110 which pierces the power plane 100 in the up-down direction. The through hole 110 extends between the ground plane 200 and the signal plane 300. The connecting portion 412 extends from the ground plane 200 to the signal plane 300 through the through hole 110 without being in electrical contact with the power plane 100.

The body portion 416 of the stub 410 according to the present embodiment extends helically in the stub plane 400 (i.e. in a plane perpendicular to the up-down direction). The body portion 416 has an end connected to the connecting portion 412, and another open end. Thus, the body portion 416 is connected to the connecting portion 412 while not being in contact with the power plane 100. The body portion 416 is arranged so that the power plane 100 is located between the body portion 416 and the ground plane 200 in the up-down direction.

According to the present embodiment, a path length of the body portion 416 of the stub 410 (i.e. stub-length (L)) is designed based on the frequency ($f_0$) of the standing wave which is generated between the power plane 100 and the ground plane 200. More specifically, the stub-length (L) is designed so that the stub 410 has a resonant frequency equal to the frequency ($f_0$). When the stub 410 is configured as described above, the noise having the frequency ($f_0$) can be effectively reduced by a wave reflected from the open end of the stub 410. In other words, it is possible to select the frequency of the noise that should be reduced by changing the stub-length (L).

The frequency (i.e. resonant frequency) of the standing wave which is generated between the power plane 100 and the ground plane 200 can be calculated from some parameters including a size of the multilayer board 10. Thus, a position of the anti-node of the standing wave can be known before the electric components such as the IC chip 310 are arranged. The arrangement of the stub 410 at the position of the anti-node of the standing wave can reduce the noise more effectively. Moreover, although a plurality of the standing waves (i.e. noises) having various frequencies might be generated in the multilayer board 10, the noises can be reduced further effectively when a plurality of stubs 410 (see FIG. 1) corresponding to these respective frequencies are provided.

The aforementioned body portion 416 of the stub 410 has the helical shape so that the stub 410 can be arranged in a compact configuration. However, the body portion 416 may have any shape, provided that the body portion 416 does not have any two paths which are excessively close to each other. For example, the body portion 416 may have a linear shape or a meander shape. Moreover, a positional relation between the power plane 100 and the ground plane 200 may be overturned.

Second Embodiment

Figure 2:
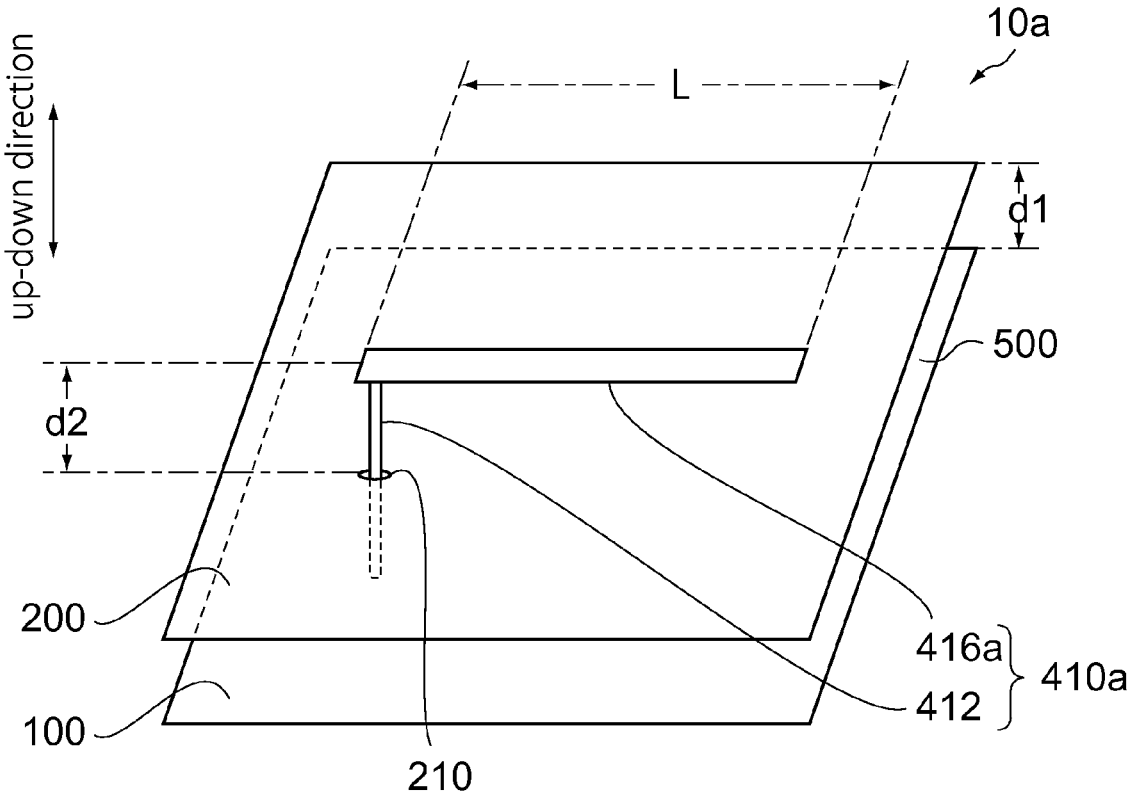
FIG. 2 is a perspective view schematically showing a power plane, a ground plane and a stub of a multilayer board which is provided with the stub according to a second embodiment of the present invention.

As shown in FIG. 2, a multilayer board **10*a* according to a second embodiment of the present invention comprises the power plane 100, the ground plane 200 and the stub plane (not shown). Similar to the first embodiment, the power plane 100 and the ground plane 200 are apart from each other in the up-down direction. Moreover, similar to the first embodiment, the ground plane 200 and the stub plane (not shown) are apart from each other in the up-down direction. In detail, the multilayer board 10*a* has the dielectric layer 500 formed between the power plane 100 and the ground plane 200. The dielectric layer 500 has a thickness of d1. The multilayer board 10*a* also has a dielectric layer formed between the ground plane 200 and the stub plane (not shown). The dielectric layer has a thickness of d2. The ground plane 200 is formed with a through hole 210 which pierces the ground plane 200 in the up-down direction. The through hole 210 extends between the power plane 100 and the stub plane (not shown). The ground plane 200 according to the present embodiment is located between the power plane 100** and the stub plane (not shown) in the up-down direction.

As shown in FIG. 2, the multilayer board **10*a* further comprises a stub (resonator) 410*a*. The stub 410*a* according to the present embodiment includes the connecting portion 412 and a body portion 416*a*. The connecting portion 412 of the stub 410*a* is connected to the power plane 100. The connecting portion 412 extends in the up-down direction to the stub plane (not shown) beyond the ground plane 200 through the through hole 210 without being in electrical contact with the ground plane 200. Similar to the first embodiment, the body portion 416*a* is arranged on the stub plane (not shown). The body portion 416*a* according to the present embodiment extends long in a direction perpendicular to the up-down direction. Similar to the first embodiment, the stub-length (L) of the stub 410*a* is designed so that the stub 410*a*** has a resonant frequency which is equal to the frequency ($f_0$) of the standing wave.

Figure 3:
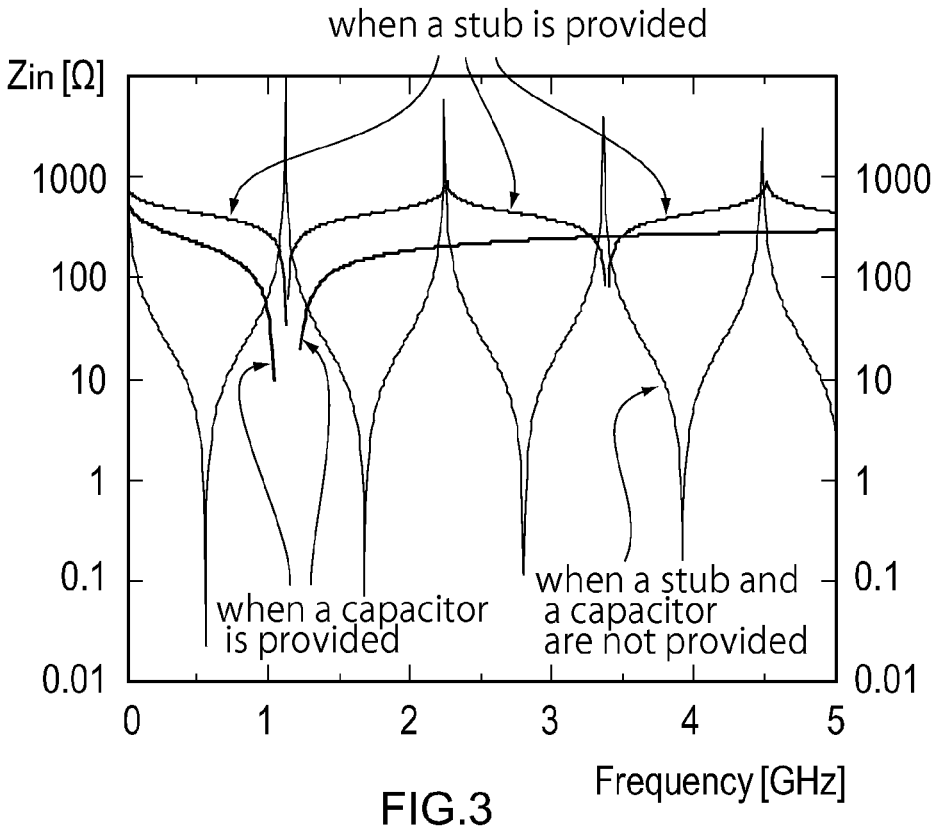
FIG. 3 is a graph showing input impedance characteristic of an example multilayer board including a power plane and a ground plane. The graph shows the input impedance under each of three cases: the multilayer board has the stub shown in FIG. 2; the multilayer board has a capacitor provided between the power plane and the ground plane; and the multilayer board does not have the stub and the capacitor.

As can be seen from FIG. 3, similar to the stub 410 according to the first embodiment, the stub **410*a* configured as described above can reduce a noise (i.e. standing wave) generated from the multilayer board 10*a*** itself.

FIG. 3 shows input impedance characteristic of an example of the multilayer board **10*a*. The example of the multilayer board 10*a* shown in FIG. 3 has a rectangular shape of 15.5 mm×64.5 mm. The dielectric layer 500 of the example of the multilayer board 10*a* has a dielectric constant of 4.3. If the stub 410*a* is not provided, the example of the multilayer board 10*a* has high impedance ($Z_{11}$) at a frequency of each of multiples of 1.1 GHz (see the graph identified by "when a stub and a capacitor are not provided" in FIG. 3). Accordingly, the example of the multilayer board 10***a* shown in FIG. 3 tends to generate standing waves each having a frequency of 1.1 GHz or a multiple of 1.1 GHz.

For example, if the multilayer board 10*a* has a capacitor (not shown) provided between the power plane 100 and the ground plane 200 of FIG. 2, the input impedance at the frequency of 1.1 GHz is lowered (see the graph identified by "when a capacitor is provided" in FIG. 3). However, when the multilayer board 10*a* is thus configured, the input impedance at the frequency other than 1.1 GHz tends to be lowered. In detail, if the capacitor (not shown) is provided, the multilayer board 10*a* generates an anti-resonance having a frequency different from the frequency of the standing wave which is generated when the capacitor is not provided. If a plurality of the capacitors (not shown) is provided, more anti-resonances having different frequencies from one another are generated. In other words, the input impedance characteristic of the multilayer board 10*a* might be undesirably affected.

According to the present embodiment, it is possible to lower the input impedance at the frequency of 1.1 GHz multiplied by an odd number without lowering the input impedance at the other frequency (see the graph identified by "when a stub is provided" in FIG. 3). In other words, it is possible to effectively reduce the standing wave having the frequency of 1.1 GHz multiplied by an odd number.

As can be seen from the above description, each of the multilayer boards 10 and 10*a* has a first plane which is one of the power plane 100 and the ground plane 200 being apart from each other in the up-down direction. The multilayer boards 10 and 10*a* are provided with the stubs (resonators) 410 and 410*a*, respectively. Each of the stubs 410 and 410*a* is connected to the first plane. The thus-configured multilayer boards 10 and 10*a* can more effectively and more easily reduce the noise generated between the power plane 100 and the ground plane 200.

The connecting portion 412 of each of the stubs 410 and 410*a* is connected to the first plane. In addition, the connecting portion 412 extends in the up-down direction beyond a second plane, which is a remaining one of the power plane 100 and the ground plane 200, while not being in electrical contact with the second plane. For example, the second plane may be formed with the through hole 110 or 210 which pierces the second plane in the up-down direction. The connecting portion 412 may extend through the through hole 110 or 210. Each of the body portions 416 and 416*a* of the stub 410 and 410*a* is connected to the connecting portion 412 while not being in contact with the second plane. The body portion 416 (or 416*a*) is arranged so that the second plane is located between the body portion 416 (or 416*a*) and the first plane in the up-down direction.

Each of the stubs 410 and 410*a* may be variously modified as described below.

Third Embodiment

Figure 4:
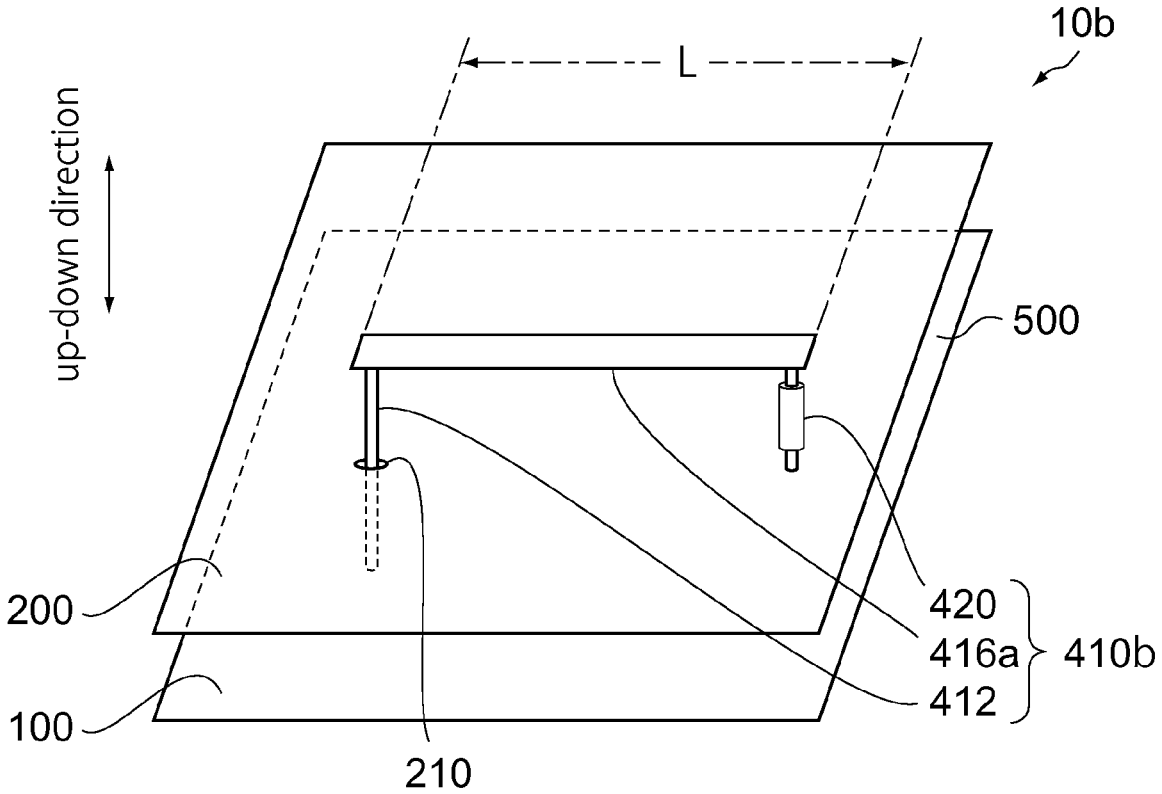
FIG. 4 is a perspective view schematically showing a power plane, a ground plane and a stub of a multilayer board which is provided with the stub according to a third embodiment of the present invention.

As shown in FIG. 4, a multilayer board 10*b* according to a third embodiment of the present invention is configured similar to the multilayer board 10*a*. However, the multilayer board 10*b* comprises a stub (resonator) 410*b* which is slightly different from the stub 410*a*.

More specifically, the stub 410*b* according to the present embodiment includes, in addition to the connecting portion 412 and the body portion 416*a*, a loss component 420 which attenuates high frequency power while preventing loss of direct-current power. The loss component 420 according to the present embodiment is the resistor 420 connected to the body portion 416*a*. In other words, the body portion 416*a* of the stub 410*b* has the resistor (loss component) 420. In detail, the resistor 420 according to the present embodiment has an end connected to an end of the body portion 416*a*, and an open end. The resistor 420 has a resistance value which may be designed on the basis of the characteristic impedance of the body portion 416*a* of the stub 410*b*. For example, the resistance value of the resistor 420 may be between ten times and thirty times the characteristic impedance of the body portion 416*a*. According to the present embodiment, one of the ends of the resistor 420 is opened so that direct current does not flow through the resistor 420. Accordingly, the thus-configured resistor 420 can prevent the loss of the direct-current power. The stub 410*b* may further have a capacitor provided between the body portion 416*a* and the resistor 420. For example, the capacitor of the stub 410*b* may be a surface mount capacitor, an embedded capacitor, or a plane capacitor which is formed from copper patterns to have a comb-like shape.

Figure 5:
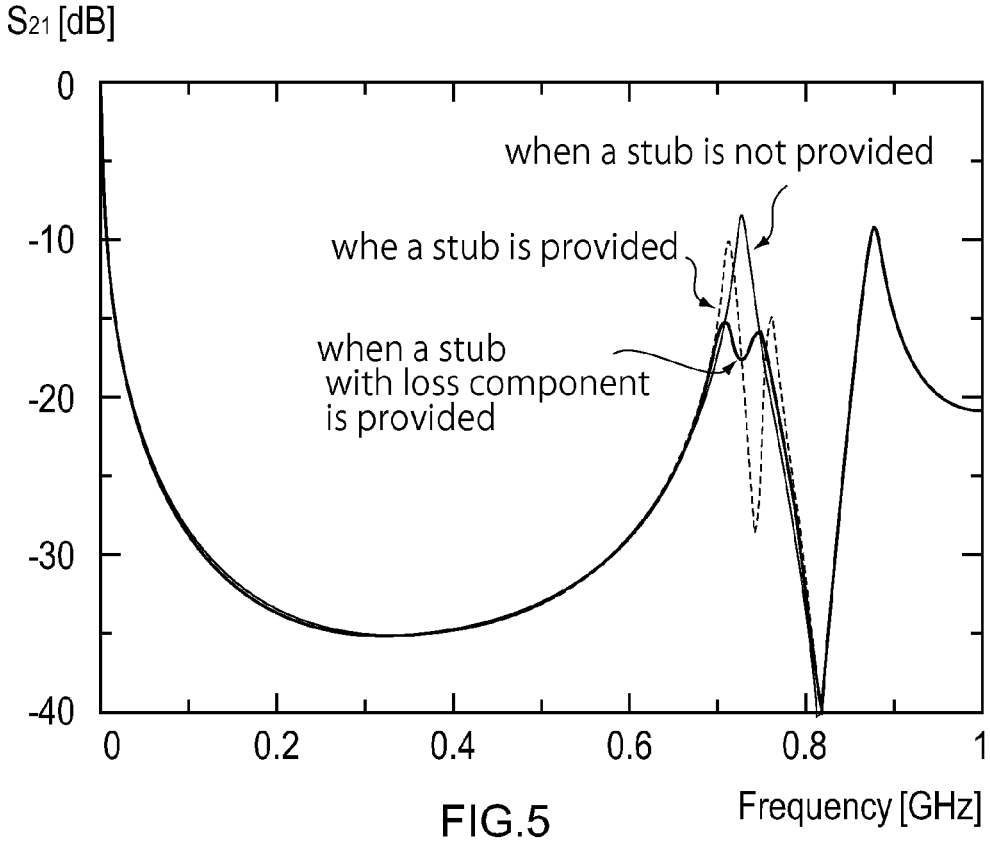
FIG. 5 is a graph showing attenuation characteristic between two ports of an example multilayer board including a power plane and a ground plane. The graph shows each of the attenuation characteristic under each of three cases: the multilayer board has the stub shown in FIG. 2; the multilayer board has the stub shown in FIG. 4; and the multilayer board has no stub.

As shown in FIG. 5, an example of the standing wave having the resonant frequency of about 0.7 GHz is generated if the multilayer board 10*b* does not have the stub 410*b*. As can be seen from FIG. 5, it is possible to attenuate the standing wave by providing not the stub 410*b* but the stub 410 according to the first embodiment or the stub 410*a* according to the second embodiment (see the graphs identified by "when a stub is not provided" and "when a stub is provided" in FIG. 5). However, when the stub 410 or the stub 410*a* is provided, anti-resonances, each of which has a frequency slightly lower or higher than the resonant frequency, may be generated (see the graph identified by "when a stub is provided" in FIG. 5). On the other hand, the stub 410*b* according to the present embodiment includes the resistor (loss component) 420 so that it is possible to suppress the anti-resonances (see the graphs identified by "when a stub with loss component is provided" in FIG. 5).

Figure 6:
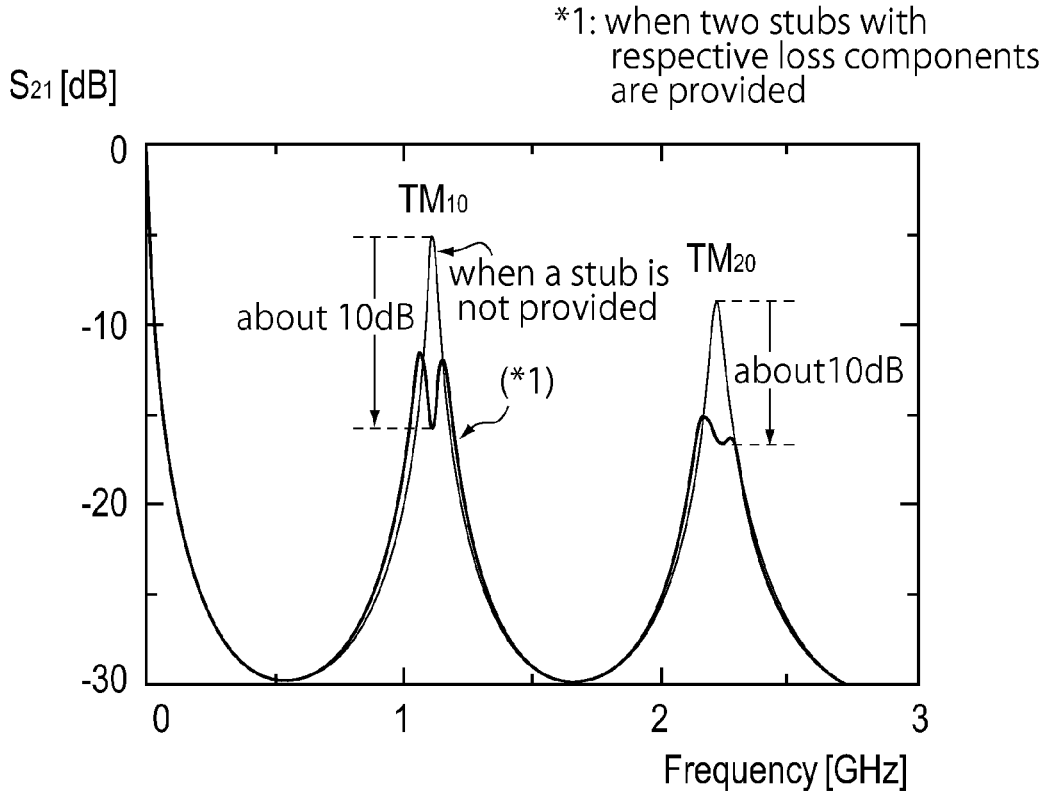
FIG. 6 is another graph showing attenuation characteristic between two ports of another example multilayer board including a power plane and a ground plane. The graph shows each of the attenuation characteristic under each of two cases: the multilayer board has the two stubs shown in FIG. 4; and the multilayer board has no stub.

As can be seen from FIG. 6, the multilayer board 10*b* may be provided with a plurality of the stubs 410*b*. As shown in FIG. 6, under a case where the multilayer board 10*b* generates the two standing waves having respective frequencies of, for example, 1.1 GHz and 2.2 GHz, it is possible to more effectively attenuate the two standing waves by providing the two stubs 410*b* (i.e. the first stub 410*b* and the second stub 410*b*) including the respective resistors (loss components) 420. In detail, the first stub 410*b* may be provided at a position of the anti-node of one of the standing waves, for example, the standing wave having frequency of 1.1 GHz, while the second stub 410*b* may be provided at a position of the anti-node of remaining one of the standing waves, for example, the standing wave having frequency of 2.2 GHz.

As can be seen from FIG. 6, the first stub 410*b* attenuates the peak level ($TM_{10}$) at 1.1 GHz by about 10 dB. The second stub 410*b* attenuates the peak level ($TM_{20}$) at 2.2 GHz by about 10 dB. Even if only one of the first stub 410*b* and the second stub 410*b* is provided, it is possible to attenuate the peak level at 1.1 GHz or 2.2 GHz by about 10 dB without affecting the level at the other frequency. Thus, when the two or more stubs 410*b* are provided so as to correspond to the respective frequencies of the two or more standing waves, it is possible to attenuate the target standing waves (noises) while suppressing the anti-resonance.

Fourth Embodiment

Figure 7:
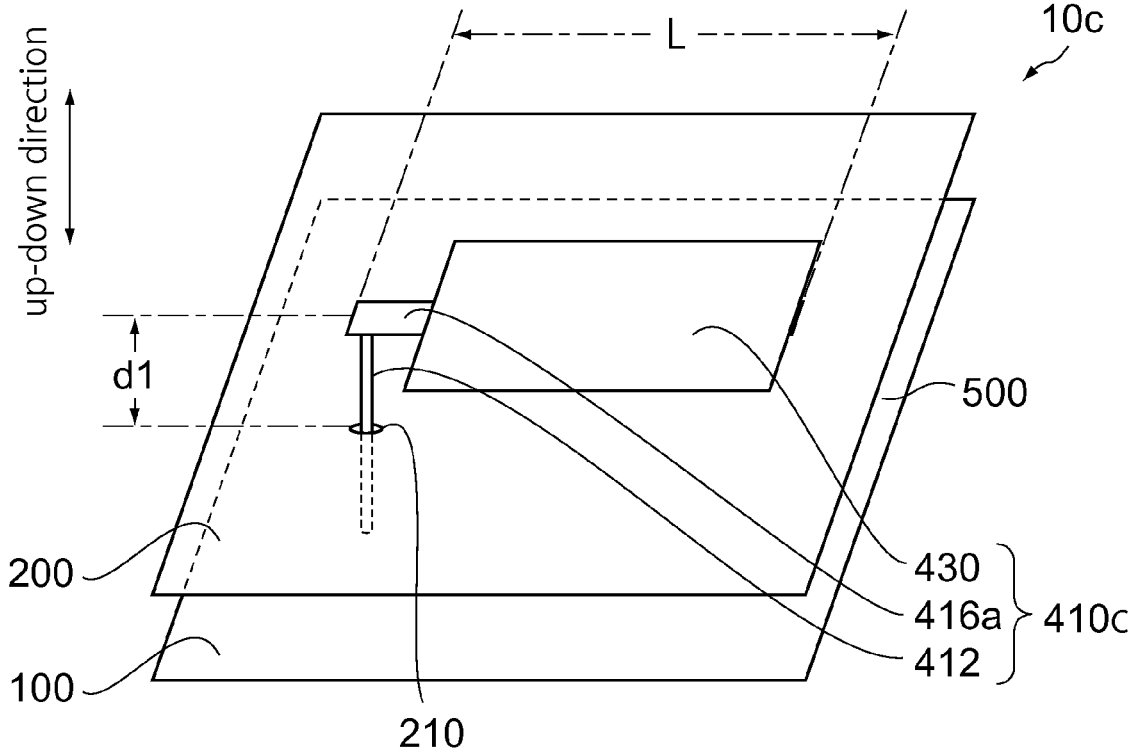
FIG. 7 is a perspective view schematically showing a power plane, a ground plane and a stub of a multilayer board which is provided with the stub according to a fourth embodiment of the present invention.

As shown in FIG. 7, a multilayer board 10*c* according to a fourth embodiment of the present invention is configured similar to the multilayer board 10*b*. However, the multilayer board 10*c* comprises a stub (resonator) 410*c* which is slightly different from the stub 410*b*.

More specifically, the stub 410*c* according to the present embodiment includes, instead of the resistor 420 (see FIG. 4), a magnetic body 430 as the loss component 430 which is reducible high frequency power while preventing loss of direct-current power. In other words, the loss component 430 of the stub 410*c* according to the present embodiment is the magnetic body 430 which is arranged close to the body portion 416*a*. In detail, the loss component 430 according to the present embodiment is the imaginary part of the magnetic permeability of the magnetic body 430. For example, the magnetic body 430 is applied on the body portion 416*a*. The thus-configured stub 410 does not only show the similar effect to the stub 410*b* but also reduces the standing waves of more wide range of frequency in some cases.

Figure 8:
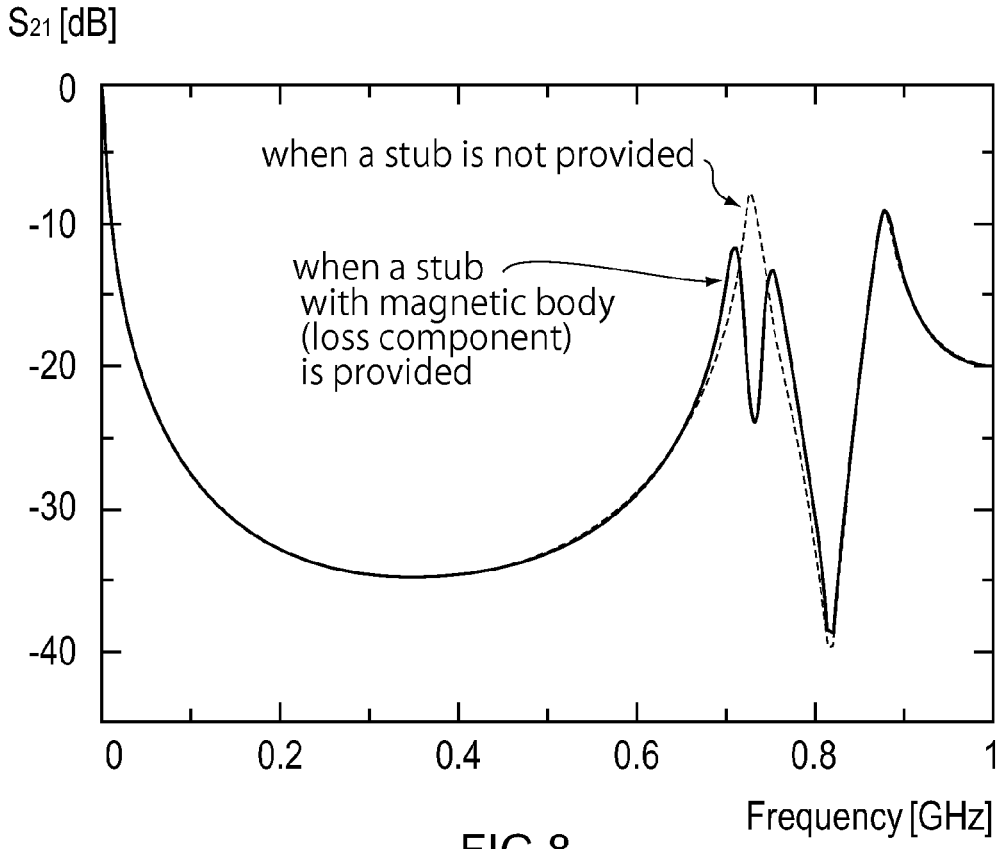
FIG. 8 is still another graph showing attenuation characteristic between two ports of still another example multilayer board including a power plane and a ground plane. The graph shows the attenuation characteristic under each of two cases: the multilayer board has the stub shown in FIG. 7; and the multilayer board has no stub.

FIG. 8 shows the attenuation characteristic between two ports of an example of the multilayer board 10*c*. The magnetic body 430 of the stub 410*c* of the example of the multilayer board 10*c* shown in FIG. 8 is formed from a thin magnetic film. In detail, the thin magnetic film is directly formed on the body portion 416*a* so that this thin magnetic film works as the magnetic body 430. The thin magnetic film has a thickness of 2 μm and a μ" (i.e. an imaginary part of magnetic permeability) of 1.5. As can be seen from FIG. 8, because the stub 410*c* includes the aforementioned magnetic body 430, the stub 410*c* is attenuatable the standing wave (for example, as shown in FIG. 8, the standing wave has the resonant frequency of about 0.7 GHz) while suppressing the anti-resonance (see the graphs identified by "when a stub is not provided" and "when a stub with magnetic body (loss component) is provided" in FIG. 8).

As can be seen from FIGS. 7 and 8, according to the present embodiment, when the properly formed magnetic body 430 is arranged properly, it is possible to attenuate the standing wave with suppression of the anti-resonance. More specifically, as described below, it is necessary to properly design a loss-factor of the magnetic body 430 (i.e. the value of the imaginary part of the magnetic permeability of the magnetic body 430), a volume of the magnetic body 430 (i.e. a width, a length and a thickness of the magnetic body 430), and a distance between the magnetic body 430 and the body portion 416*a*. For example, the standing wave can be more attenuated as the result value (loss-contribution value) of the loss-factor of the magnetic body 430 multiplied by the volume of the magnetic body 430 becomes larger. When the aforementioned loss-contribution value is too large, the loss-contribution value can be adjusted by enlarging the distance between the magnetic body 430 and the body portion 416*a*.

It is preferred that the magnetic body 430 have the high loss-factor (the value of the imaginary part of the magnetic permeability) at the frequency of the standing wave generated in the multilayer board 10*c*. More specifically, the loss-factor of the magnetic body 430 is preferred to be equal to or more than 0.1. When the magnetic body 430 has the high loss-factor, the standing wave can be attenuated even if the magnetic body 430 has the volume of reduced size.

The magnetic body 430 is also preferred to have a high surface resistivity. More specifically, the surface resistivity of the magnetic body 430 is preferred to be equal to or more than $10^2$ Ω/sq. As the surface resistivity of the magnetic body 430 is higher, malfunction such as changes of electric circuit constants around the magnetic body 430 can be more hardly caused.

The magnetic body 430 may be arranged to be in contact with the body portion 416*a* of the stub 410*c* by applying a magnetic material or forming a magnetic film. Alternatively, the magnetic body 430 may be arranged in the vicinity of the body portion 416*a* of the stub 410*c*. When the magnetic body 430 is arranged in the vicinity of the body portion 416*a*, a thin magnetic film may be used as the magnetic body 430. For example, the thin magnetic film may be formed on a substrate made of a resin such as a polyimide. The thus-formed magnetic body 430 may be stuck to the body portion 416*a* via an adhesive layer. Moreover, for example, the magnetic body 430 may be arranged on the body portion 416*a* via an insulating layer such as a solder resist.

The magnetic body 430 according to the present embodiment may be formed from various materials. For example, the magnetic body 430 may be a thin film having a soft magnetism. More specifically, the magnetic body 430 may be a ferrite thin film. The magnetic body 430 may be a magnetic paste made of a medium and powders distributed in the medium. For example, the medium may be a resin. The powders may have soft magnetism such as metal powders or ferrite powders. Moreover, the magnetic body 430 may be a sintered body made of a ferrite. However, as described below, the magnetic body 430 is preferred to be a ferrite plating film.

The ferrite plating film may be formed by forming a spinel ferrite material represented by the formula of $MFe_2O_4$, wherein M is a metal element, on a medium via a ferrite plating method. For example, the metal element (M) is at least one element selected from the group consisting of Ni, Zn, Co, Mn and Fe. According to the ferrite plating method, a solution containing metal ions such as $Ni^{2+}$, $Zn^{2+}$, $Co^{2+}$, $Mn^{2+}$ and/or $Fe^{2+}$ is brought into contact with a surface of the medium so that the metal ions are absorbed on the surface of the medium. Then, $Fe^{2+}$ ion is oxidized by an oxidizing agent or the like to become $Fe^{3+}$ ion. $Fe^{3+}$ ion and the metal hydroxide in the solution undergo ferrite crystallization reaction so that the ferrite film is formed on the medium.

The ferrite plating method is an electroless plating using water solution process. The ferrite plating film can be directly formed on the medium such as a resin film or a printed circuit board via the ferrite plating method. Moreover, according to the ferrite plating method, the film having not only a relatively high surface resistance but also a superior magnetic characteristic can be obtained without heat-treatment.

The ferrite plating film, which is formed as described above, has a high magnetic permeability even in a high frequency range as compared with a bulk ferrite or a complex of magnetic powders and a resin. Moreover, it is easy to change the frequency characteristic of the magnetic permeability by changing the composition. In other words, the composition of the ferrite plating film is designable according to the frequency of the standing wave which may be generated in the multilayer board 10*c*. For example, if the ferrite plating film has the composition of $Ni_aZn_bCo_cMn_dFe_eO_4$, wherein $0 \le a \le 0.4$, $0 \le b \le 0.5$, $0 \le c \le 0.4$, $0 \le d \le 0.4$, $2.0 \le e \le 2.8$ and $a+b+c+d+e=3$, it is possible to obtain a high surface resistance and a superior characteristic of magnetic permeability in a high frequency range. As the ferrite plating film has a larger film thickness, the ferrite plating film has the higher loss-factor (the value of the imaginary part of the magnetic permeability). However, the ferrite plating film is preferred to have the film thickness between 0.2 μm and 20 μm. When the film thickness is between 0.2 μm and 20 μm, the standing wave is attenuated while the anti-resonance is suppressed. Moreover, when the film thickness is between 0.2 μm and 20 μm, the ferrite plating film securely adheres to the body portion 416*a* in a direct or indirect manner. In detail, the ferrite plating film securely adheres not only to the body portion 416*a* but also to the aforementioned medium made of the resin such as the polyimide or the aforementioned insulating layer such as the solder resist.

As described above, the resonator according to each of the aforementioned embodiments is formed from an open stub which has an open end. In other words, the resonator is a $\lambda/4$ resonator. However, the resonator of the present invention may not be such an open stub. Moreover, the resonator according to each of the aforementioned embodiments is variously modifiable in addition to the aforementioned modifications. For example, the loss component may be attached to the connecting portion of the resonator. However, considering a manufacturing process, the loss component is preferred to be provided in the signal plane which is formed on the surface of the multilayer board. Moreover, the loss component may be provided in a method where the stub itself is formed as a resistive element having a predetermined resistance. For example, the stub may be formed from a resistive element having a resistivity larger than the copper. Moreover, the loss component may be provided in a method where a dielectric body having a dielectric loss-factor (the value of the imaginary part of the magnetic permeability) is arranged to be close to the stub.

The present application is based on Japanese patent applications JP2012-186548 filed in the Japan Patent Office on Aug. 27, 2012 and JP2013-082762 filed in the Japan Patent Office on Apr. 11, 2013, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A resonator comprising:

a connecting portion connected to a first plane, the connecting portion extending in an up-down direction beyond a second plane while not being in electrical contact with the second plane; and a body portion connected to the connecting portion while not being in contact with the second plane, the body portion being arranged so that the second plane is located between the body portion and the first plane in the up-down direction, wherein the first plane and the second plane are apart from each other in the up-down direction, and the first plane is one of a power plane and a ground plane and the second plane is the other of the power plane and the ground plane, wherein the resonator is configured to operate as a stub, and wherein the body portion of the resonator includes a loss component which receives power from the power plane and attenuates high frequency power while preventing loss of direct-current power.

2. The resonator as recited in claim 1, wherein:

the second plane is formed with a through hole which pierces the second plane in the up-down direction; and the connecting portion extends through the through hole.

3. The resonator as recited in claim 1, wherein the body portion of the resonator extends horizontally in a plane perpendicular to the up-down direction.

4. The resonator as recited in claim 1, wherein the body portion of the resonator extends helically in a plane perpendicular to the up-down direction.

5. The resonator as recited in claim 1, wherein the loss component is a resistor connected to the body portion.

6. The resonator as recited in claim 1, wherein the loss component is a magnetic substance which is arranged close to the body portion.

7. The resonator as recited in claim 6, wherein the magnetic body contains a ferrite having a formula of $MFe_2O_4$, wherein M is a metal element.

8. The resonator as recited in claim 6, wherein the magnetic body is ferrite plated.

9. A multilayer board comprising:

one or more power planes, the power planes including one predetermined power plane;

one or more ground planes, the ground planes including one predetermined ground plane which is apart from the predetermined power plane in an up-down direction; and at least one resonator connected to a first plane, the resonator having a connecting portion and a body portion, wherein the connecting portion is connected to the first plane, and extends in the up-down direction beyond a second plane while not being in electrical contact with the second plane, wherein the body portion is connected to the connecting portion while not being in contact with the second plane, and the body portion is arranged so that the second plane is located between the body portion and the first plane in the up-down direction, wherein the first plane and the second plane are apart from each other in the up-down direction, and the first plane is one of the predetermined power plane and the predetermined ground plane and the second plane is the other of the predetermined power plane and the predetermined ground plane, wherein the resonator is configured to operate as a stub, and wherein the body portion of the resonator includes a loss component which receives power from the predetermined power plane and attenuates high frequency power while preventing loss of direct-current power.

10. The multilayer board as recited in claim 9, wherein the at least one resonator comprises a plurality of the resonators.

11. An electronic device comprising the multilayer board as recited in claim 9.

* * * * *